US011781501B2

(12) United States Patent
Tamura et al.

(10) Patent No.: US 11,781,501 B2
(45) Date of Patent: Oct. 10, 2023

(54) ENGINE HEAD STRUCTURE

(71) Applicant: KUBOTA Corporation, Osaka (JP)

(72) Inventors: Akira Tamura, Sakai (JP); Kensuke Fujita, Sakai (JP); Hiroki Oso, Sakai (JP); Yasushi Kobayashi, Sakai (JP); Shingo Matsunobu, Sakai (JP); Mitsugu Okuda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/785,528

(22) PCT Filed: Mar. 8, 2021

(86) PCT No.: PCT/JP2021/008871
§ 371 (c)(1),
(2) Date: Jun. 15, 2022

(87) PCT Pub. No.: WO2022/009471
PCT Pub. Date: Jan. 13, 2022

(65) Prior Publication Data

US 2023/0008602 A1 Jan. 12, 2023

(30) Foreign Application Priority Data

Jul. 7, 2020 (JP) ..... 2020-117286

(51) Int. Cl.
*F02F 1/24* (2006.01)
*F02M 35/02* (2006.01)
*F02M 55/02* (2006.01)

(52) U.S. Cl.
CPC ..... *F02F 1/242* (2013.01); *F02M 55/025* (2013.01); *F02M 2200/857* (2013.01)

(58) Field of Classification Search
CPC ..... F02F 1/242; F02F 1/24; F02M 55/025; F02M 55/02; F02M 63/0225; F02M 63/02; F02M 2200/857; F02M 2200/856
See application file for complete search history.

(56) References Cited

U.S. PATENT DOCUMENTS 6,640,784 B1 11/2003 Sims, Jr.
7,143,749 B1 * 12/2006 Colletti ..... F02M 69/465 123/469

(Continued)

FOREIGN PATENT DOCUMENTS

DE 102019207390 A1 * 11/2020 ..... F02M 55/005
EP 2690281 A1 * 1/2014 ..... F02M 55/025

(Continued)

OTHER PUBLICATIONS

Machine translation of Detailed Description, DE-102019207390-A1 to Hall, obtained from https://worldwide.espacenet.com/, pp. 1-14. (Year: 2019).*

(Continued)

*Primary Examiner* — Grant Moubry
*Assistant Examiner* — James G Moubry
(74) *Attorney, Agent, or Firm* — Panitch Schwarze Belisario & Nadel LLP

(57) ABSTRACT

To provide an engine head structure for "omission or shortening a fuel pipe that withstands a high pressure", "simplification or omission of a support bracket for a fuel accumulator and/or a fuel injection device", "reduction of the number of parts" by devising a fuel accumulator and a support structure therefor, and the like. An engine head structure has a support bracket for mounting a fuel accumulator including a joining portion with a fuel injection device on a cylinder head, is disposed on a side of the fuel injection device or between adjacent fuel injection devices. The support bracket includes a member having a mounting (Continued)

portion on which the fuel accumulator is placed and mounted, a mounting leg portion extending from the mounting portion and mounted on the cylinder head, and an aligning leg portion extending from the mounting portion for positioning the support bracket with respect to the cylinder head.

3 Claims, 11 Drawing Sheets

(56) References Cited

U.S. PATENT DOCUMENTS

| | | | | |
|---|---|---|---|---|
| 7,159,569 | B2 * | 1/2007 | Keegan | F02M 61/166 123/456 |
| 7,347,190 | B1 * | 3/2008 | Keegan | F02M 61/168 123/456 |
| 2018/0230954 | A1 * | 8/2018 | Oh | F02M 55/025 |

FOREIGN PATENT DOCUMENTS

| | | | |
|---|---|---|---|
| JP | 6-81749 | A | 3/1994 |
| JP | 08-61133 | A | 3/1996 |
| JP | 11-13593 | A | 1/1999 |
| JP | 2015-169094 | A | 9/2015 |

OTHER PUBLICATIONS

Int'l Search Report dated Apr. 13, 2021 in Int'l Application No. PCT/JP2021/008871.

* cited by examiner (A)

(B)

(A)

(B)

ENGINE HEAD STRUCTURE

CROSS-REFERENCE TO RELATED APPLICATIONS

This application is a Section 371 of International Application No. PCT/JP2021/008871, filed Mar. 8, 2021, which was published in the Japanese language on Jan. 13, 2022, under International Publication No. WO 2022/009471 A1, which claims priority under 35 U.S.C. § 119(b) to Japanese Application No. 2020-117286, filed Jul. 7, 2020, the disclosures of all of which are incorporated herein by reference.

TECHNICAL FIELD

The present invention relates to a structure around a cylinder head of an engine having a fuel accumulator, that is, an engine head structure for an industrial diesel engine or an automobile engine.

BACKGROUND ART

An engine that uses a fuel accumulator (a common rail or the like) has, in general, a structure where a high-pressure fuel is accumulated in the fuel accumulator under pressure by a fuel pressure supply pump, and the high-pressure fuel is supplied from the fuel accumulator to fuel injection devices (injectors) disposed in respective cylinders through fuel pipes that withstand a high pressure. As such a technique, there has been known a technique disclosed in Patent Document 1 and a technique disclosed in Patent Document 2.

It has been found that the above-mentioned prior art has the following drawbacks A. to C. A. Fuel pipes that withstand a high pressure are used and hence, a pressure loss is generated in the fuel pipes, B. The fuel pipe is necessary for each fuel injection device and hence, the number of parts is increased, and C. Both the fuel accumulator and the fuel injection devices require a support member respectively and hence, the number of parts is increased.

PRIOR ART DOCUMENTS

Patent Documents

Patent Document 1: Japanese Patent Application Laid-open No. H08-061133

Patent Document 2: Japanese Patent Application Laid-open No. 2015-169094

SUMMARY OF THE INVENTION

Problems to be Solved by the Invention

As technical problems for solving the above-described drawbacks A. to C., the following problems (1) to (3) are considered. (1) Omission or shortening of fuel pipes that withstand a high pressure (2) Simplification or omission of support brackets for a fuel accumulator and/or fuel injection devices (3) Reduction of the number of parts It is an object of the present invention to provide an engine head structure capable of solving as many problems as possible among the above-mentioned problems (1) to (3) by further devising a fuel accumulator, a support structure for supporting the fuel accumulator, and the like.

Solutions to the Problems

The present invention provides an engine head structure where a support bracket for mounting a fuel accumulator that includes a joining portion with a fuel injection device on a cylinder head, is disposed on a side of the fuel injection device or between the fuel injection devices disposed adjacently to each other, in which the support bracket is formed of a member that includes a mounting portion on which the fuel accumulator is placed and mounted, a mounting leg portion that extends from the mounting portion and is mounted on the cylinder head, and an aligning leg portion that extends from the mounting portion for positioning the support bracket with respect to the cylinder head.

With respect to the second and subsequent inventions, the inventions described in Claims should be referenced.

Effects of the Invention

According to the present invention, the fuel accumulator and the fuel injection device are directly joined to each other and hence, a fuel pipe that withstands a high pressure and is conventionally necessary becomes unnecessary. Accordingly, the number of parts can be reduced and the reduction of cost can be realized. Further, a pressure loss in the fuel pipe can be eliminated.

The support bracket that supports the fuel accumulator in a state where the fuel accumulator is placed on the support bracket can be mounted on the cylinder head in a state where the support bracket is positioned by the aligning leg portion. Accordingly, by mounting the support bracket in a state where the fuel accumulator is assembled to the support bracket on the cylinder head, it is also possible to join the fuel accumulator to the fuel injection device mounted on the cylinder head. Further, the support bracket in a state where the fuel accumulator to which the fuel injection device is joined in advance is assembled to the support bracket is mounted on the cylinder head. Accordingly, the fuel injection device can be mounted on a predetermined mounting portion of the cylinder head.

Further, the fuel injection device and the fuel accumulator are directly joined to each other and hence, the fuel injection device is positioned and fixed. Accordingly, a dedicated support member for supporting the fuel injection device becomes unnecessary.

As a result, it is possible to provide an engine head structure capable of solving as many problems as possible among the above-mentioned problems (1) to (3) by further devising the fuel accumulator, the structure for supporting the fuel accumulator, and the like.

BRIEF DESCRIPTION OF THE DRAWINGS

FIG. 7(A) and FIG. 7(B) illustrate a support bracket, wherein FIG. 7(A) is a right side view, and FIG. 7(B) is a front view.

FIG. 8(A) and FIG. 8(B) illustrate the support bracket, wherein FIG. 8(A) is a plan view, and FIG. 8(B) is a front view as viewed in a Z direction in FIG. 8(A).

FIG. 9(A) and FIG. 9(B) illustrate the common rail, wherein FIG. 9(A) is a right side view, and FIG. 9(B) is a plan view.

EMBODIMENTS OF THE INVENTION

Hereinafter, an embodiment of an engine head structure according to the present invention will be described with reference to drawings with respect to a case where an engine is an industrial diesel engine mounted on an agricultural tractor or a construction machine (hereinafter, abbreviated as "engine"). With respect to the engine, a side on which a cooling fan is disposed is defined as a front side, a side on which a flywheel is disposed is defined as a rear side, a side on which an exhaust manifold is disposed is defined as a left side (exhaust side), and a side on which an intake manifold is disposed is defined as a right side (intake side).

Figure 1:
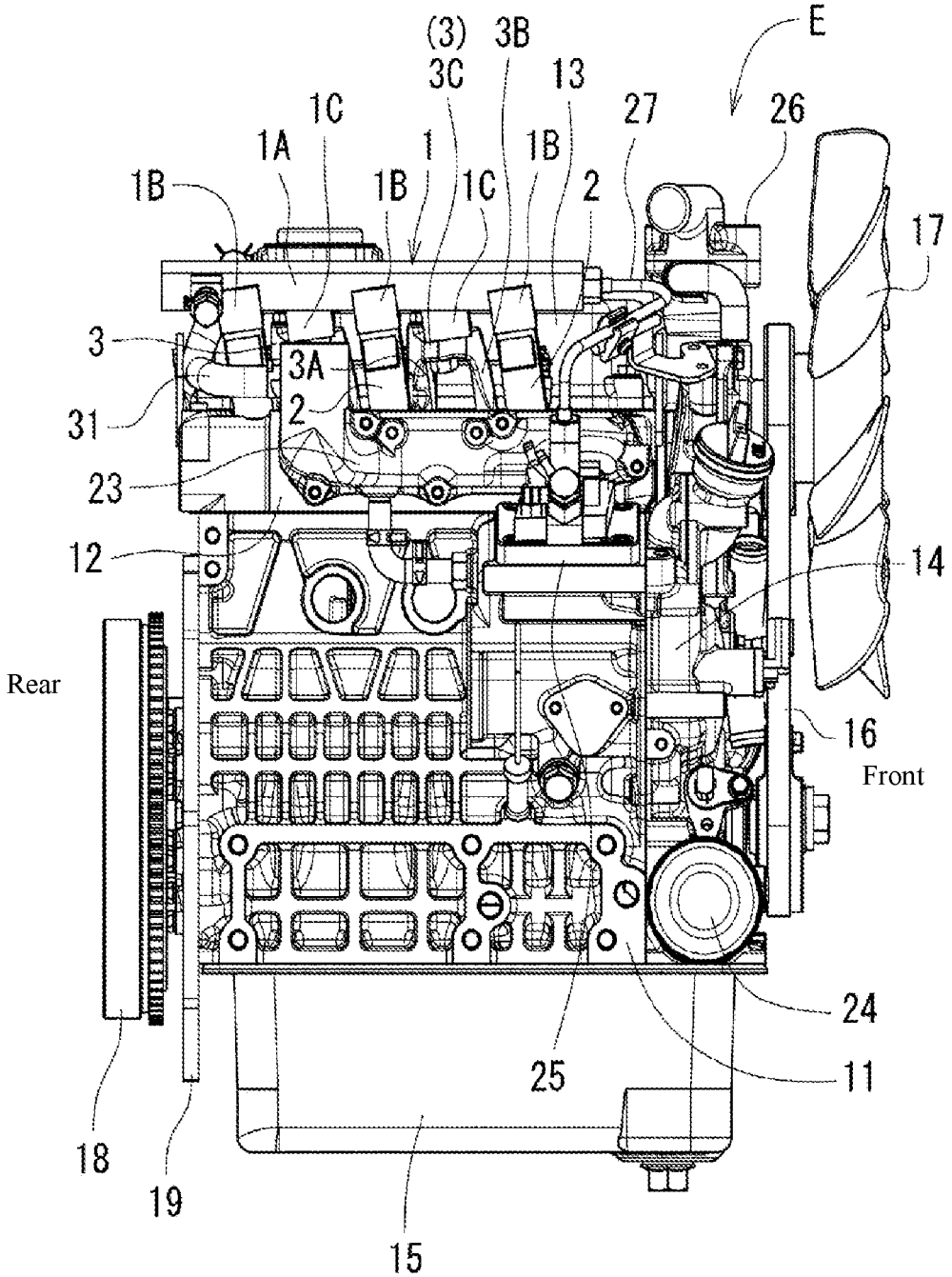
FIG. 1 is a right side view of an industrial diesel engine.
Figure 2:
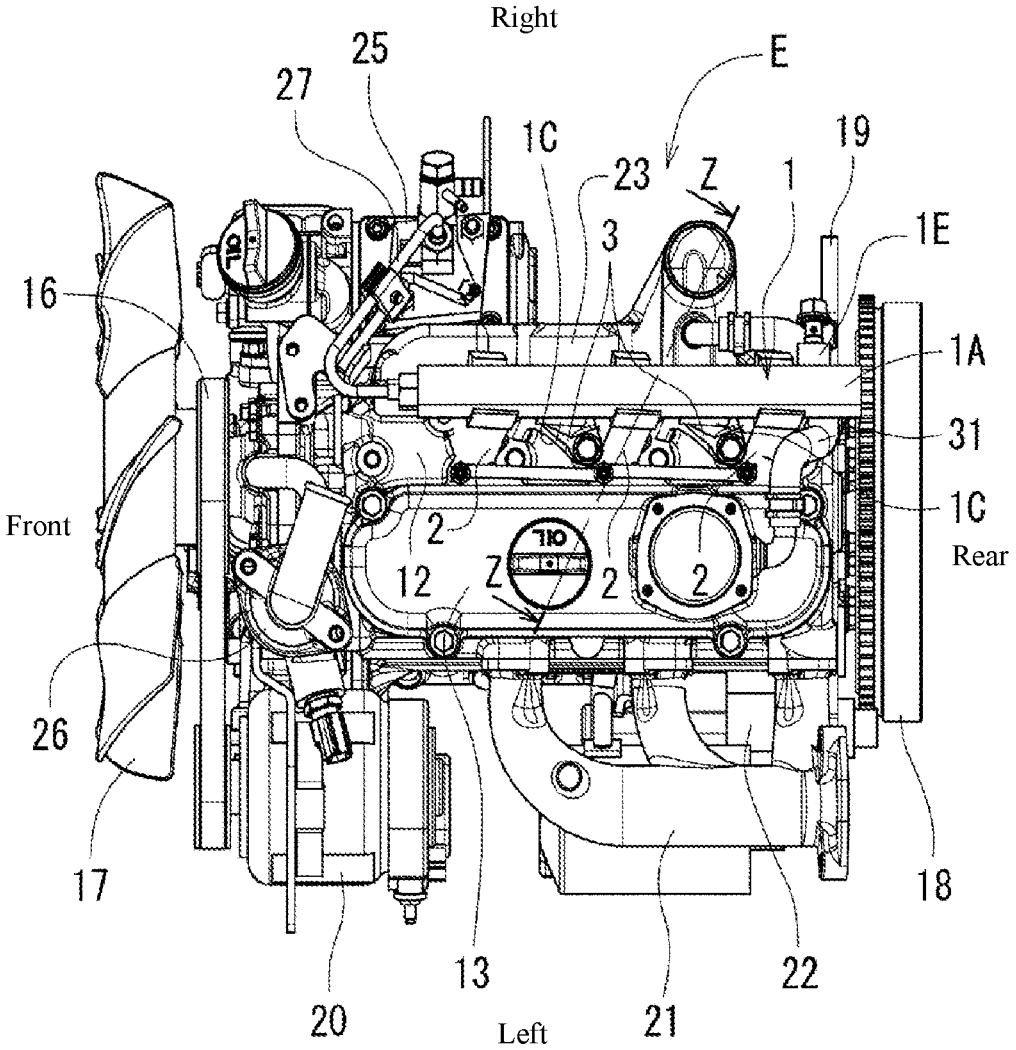
FIG. 2 is a plan view of the industrial diesel engine.
Figure 3:
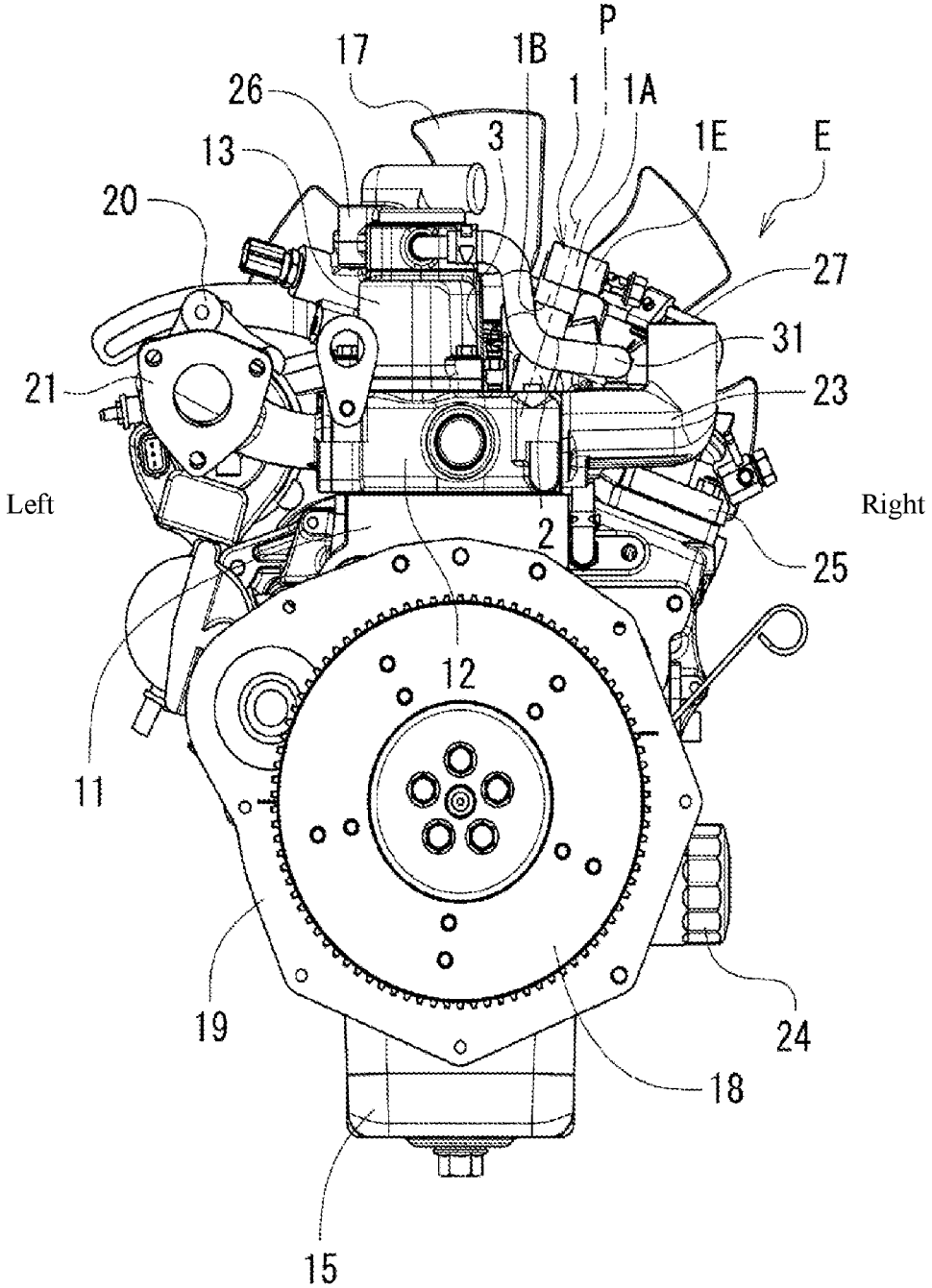
FIG. 3 is a back view of the industrial diesel engine.

FIG. 1 to FIG. 3 illustrate an in-line three-cylinder common rail type industrial diesel engine. In the engine E, a cylinder head 12 is assembled to an upper side of a cylinder block 11, and a head cover 13 is assembled to an upper side of the cylinder head 12. A transmission case 14 is assembled in front of the cylinder block 11, and an oil pan 15 is assembled below the cylinder block 11.

A power transmission belt 16, an engine cooling fan 17, and the like are disposed on a front portion of the engine E, and a flywheel 18, a flywheel housing bracket 19, and the like are disposed on a rear portion of the engine E. An alternator 20, an exhaust manifold 21, a cell starter 22, and the like are disposed on a left portion of the engine E, and an intake manifold 23, an oil filter 24, a fuel supply pump 25, and the like are disposed on a right portion of the engine E. On an upper portion of the engine E, a common rail (an example of a fuel accumulator) 1, a water flange 26, and the like are disposed.

Next, the structure of the cylinder head 12, the structure of the head cover 13 and the structure around the cylinder head 12 and the head cover 13, that is, an engine head structure will be described. As illustrated in FIG. 1 to FIG. 3 and FIG. 4 to FIG. 6, the common rail 1 is disposed above the cylinder head 12 on a right side of the head cover 13. The common rail 1 is disposed in a lying posture where the common rail 1 extends in the longitudinal direction. The common rail 1 that is directly joined to three injectors (an example of fuel injection devices) 2 mounted on the cylinder head 12 is mounted on the cylinder head 12 by two support brackets 3.

As illustrated in FIG. 1 to FIG. 3 and FIG. 4 to FIG. 6, three injectors 2, 2, and 2 are arranged in the longitudinal direction that is the cylinder in-line direction. The injectors 2, 2, and 2 are mounted on the cylinder head 12 in an inserted manner in a state where the injectors 2, 2, and 2 are erected from a head upper surface 12A that is an upper surface of the cylinder head 12. Each injector 2 has an injection axis P that is directed in the vertically oblique direction such that, as the injector 2 extends toward the right and the rear (as the injector 2 extends in the rightward and rearward directions), the axis P becomes higher.

Figure 5:
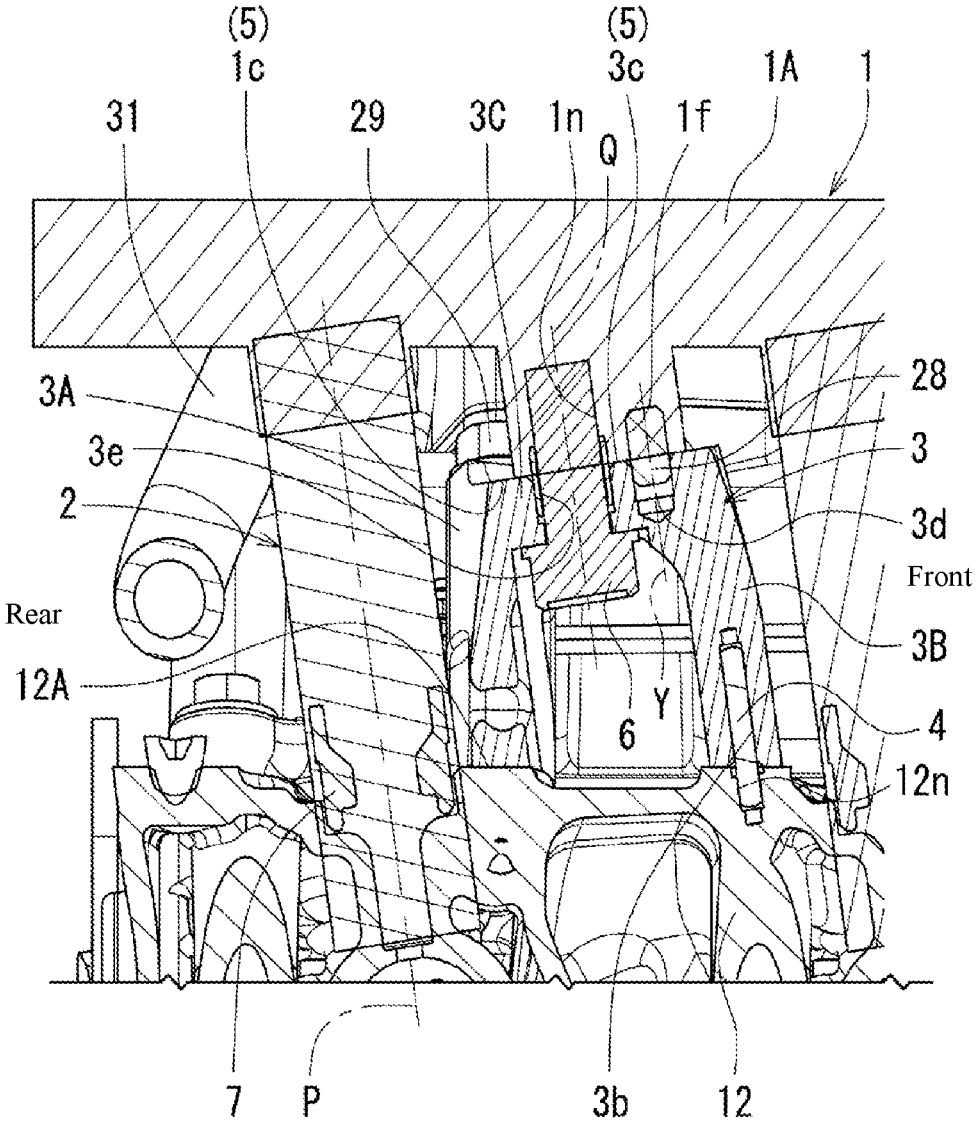
FIG. 5 is a right side view with a part broken away of the main part illustrating the structure for supporting the common rail.
Figure 10:
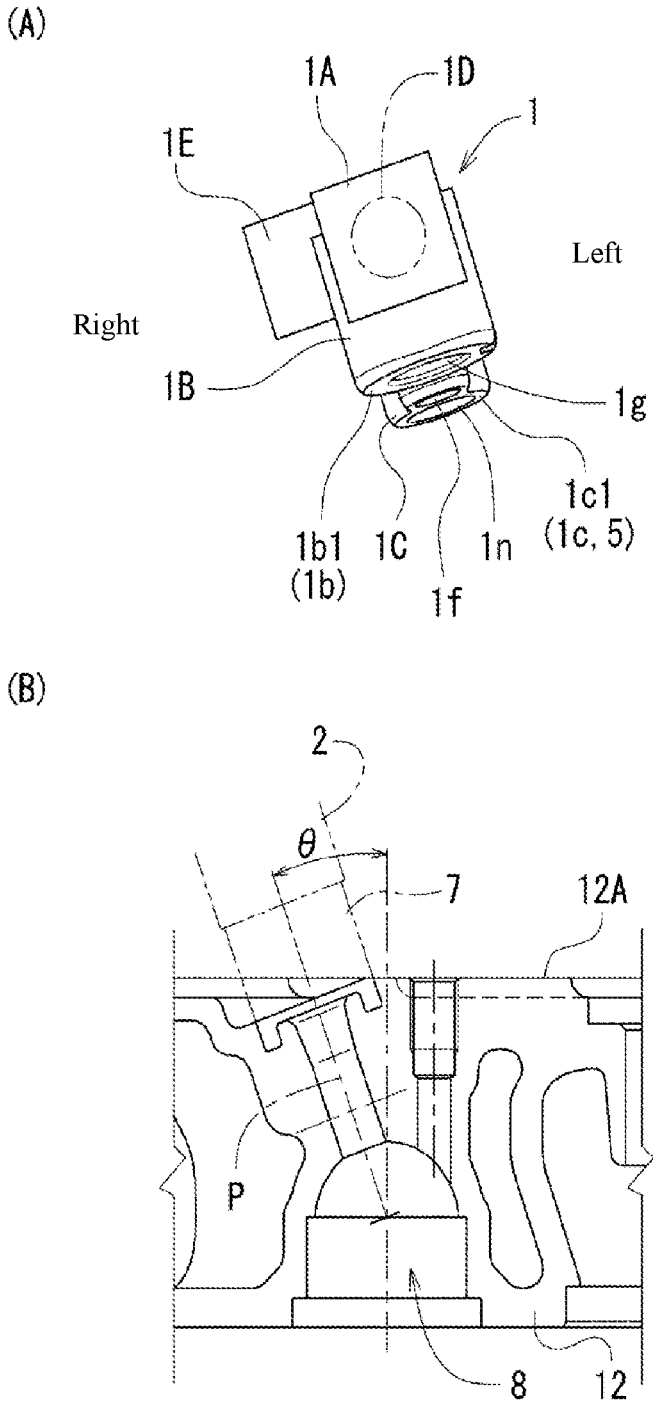
FIG. 10(A) is a front view of the common rail.
FIG. 10(B) is a cross-sectional view of a main part taken along line Z-Z in FIG. 2 for illustrating an inclination angle of an injector with respect to a cylinder head.
Figure 11:
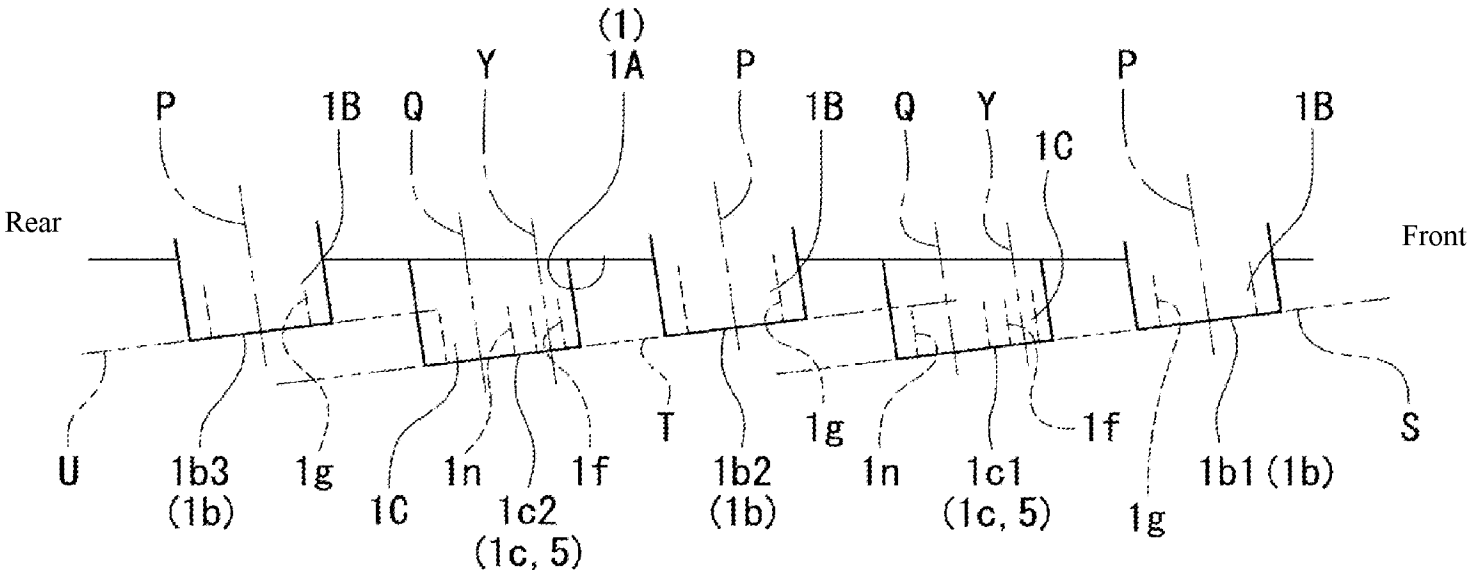
FIG. 11 is a schematic view illustrating that a mounting surface between the common rail and the support bracket and a joining surface at which the support bracket is joined to an injector are disposed on the same plane.

As illustrated in FIG. 10(B) and FIG. 11, the injection axes P are parallel to each other and are set such that the axes are inclined at an angle θ with respect to the direction perpendicular to the head upper surface 12A. The angle θ is set to 10 to 30 degrees ($10° \leq \theta \leq 30°$), and is preferably set to 20 degrees. The injector 2 is disposed in a state where a high-pressure fuel can be jetted into an auxiliary chamber 8 formed in a combustion chamber (not illustrated in the drawing). As illustrated in FIG. 5 and FIG. 10(B), an annular sleeve 7 for determining a mounting height position of the injector 2 with respect to the cylinder head 12 is mounted in the cylinder head 12 by press fitting.

As illustrated in FIG. 1 to FIG. 6, FIG. 9, and FIG. 10, the common rail 1 includes: a tubular rail body 1A elongated in the cylinder in-line direction (in the longitudinal direction); joining portions 1B that are formed on the rail body 1A at three positions so as to be jointed to the injectors 2; and two portions to be supported 1C disposed between the joining portions 1B and 1B. A supply portion 1D to which a supply pipe 27 connected to the fuel supply pump 25 is connected is formed at a front end of the rail body 1A. An overflow outlet portion 1E is formed at a rear end portion of the rail body 1A. A raised portion (not illustrated in the drawing) for mounting a pressure sensor (not illustrated in the drawing) by screwing or the like may be formed on a center portion of the rail body 1A in the longitudinal direction. A pressure regulating valve (not illustrated in the drawing) may be mounted on a rear end of the rail body 1A. The common rail 1 is mounted on the head upper surface 12A by two support brackets 3, 3 that are arranged in parallel in the longitudinal direction.

As illustrated in FIG. 4 to FIG. 8, the support bracket 3 is formed of a member (metal member) having a downwardly-opened "U" shape. The support bracket 3 has a mounting portion 3C on which the portion to be supported 1C of the common rail 1 is placed and mounted; a mounting leg portion 3A that extends from the mounting portion 3C and is mounted on the cylinder head 12; and an aligning leg portion 3B that extends from the mounting portion 3C for positioning the support bracket 3 with respect to the cylinder head 12. The shape of the support bracket 3 may be shapes other than the "U" shape, such as a "rectangular frame" shape, an approximately "it" shape, and the like.

In the mounting portion 3C, a through hole 3*e* that is directed in the vertical direction is formed. The through hole 3*e* is formed so as to allow a support bolt 6 inserted into the through hole 3*e* to threadedly engage with the portion to be supported 1C that is mounted on the upper surface 3*c* of the mounting portion 3C. A small hole 3*d* is also formed in the mounting portion 3C, and a pin 28 is inserted into the small hole 3*d* for positioning the support bracket 3 and for preventing the rotation of the support bracket 3. In the mounting leg portion 3A, a through hole 3*a* for fixing the mounting leg portion 3A to the head upper surface 12A from above using a bolt is formed. In the aligning leg portion 3B, a knock hole 3*b* through which a knock pin (an example of a knock member) 4 for determining the relative position between the support bracket 3 and the cylinder head 12 is inserted is formed. On a rear end portion of the mounting portion 3C, a seat surface 3*f* having a horizontal surface shape, that forms an opening portion of the through hole 3*a* is formed.

On an upper portion of the cylinder head 12, a nut portion 30 is formed in a state where the nut portion 30 opens on the head upper surface 12A. A bolt 29 that passes through the mounting leg portion 3A threadedly engages with the nut portion 30. A second knock hole 12*n* into which the knock pin 4 is inserted is also formed on the upper portion of the cylinder head 12. Each support bracket 3 is fixed by screwing by threadedly mounting the mounting leg portion 3A on the head upper surface 12A using the bolt 29 in a state where the aligning leg portion 3B is positioned with respect to the cylinder head 12 by the knock pin 4.

As illustrated in FIG. 5, FIG. 8(A) and FIG. 8(B), a mounting surface between the common rail 1 and the mounting portion 3C, that is, a mounting surface 5 formed by a bottom surface 1*c* of the portion to be supported 1C or the upper surface 3*c* of the mounting portion 3C exists on the same plane as a joining surface 1*b* between the injector 2 disposed adjacently to the support bracket 3 having the mounting surface 5 (the bottom surface 1*c*, the upper surface 3*c*) and the common rail 1, that is, a joining surface 1*b* formed of a lower surface of the joining portion 1B.

Figure 9:
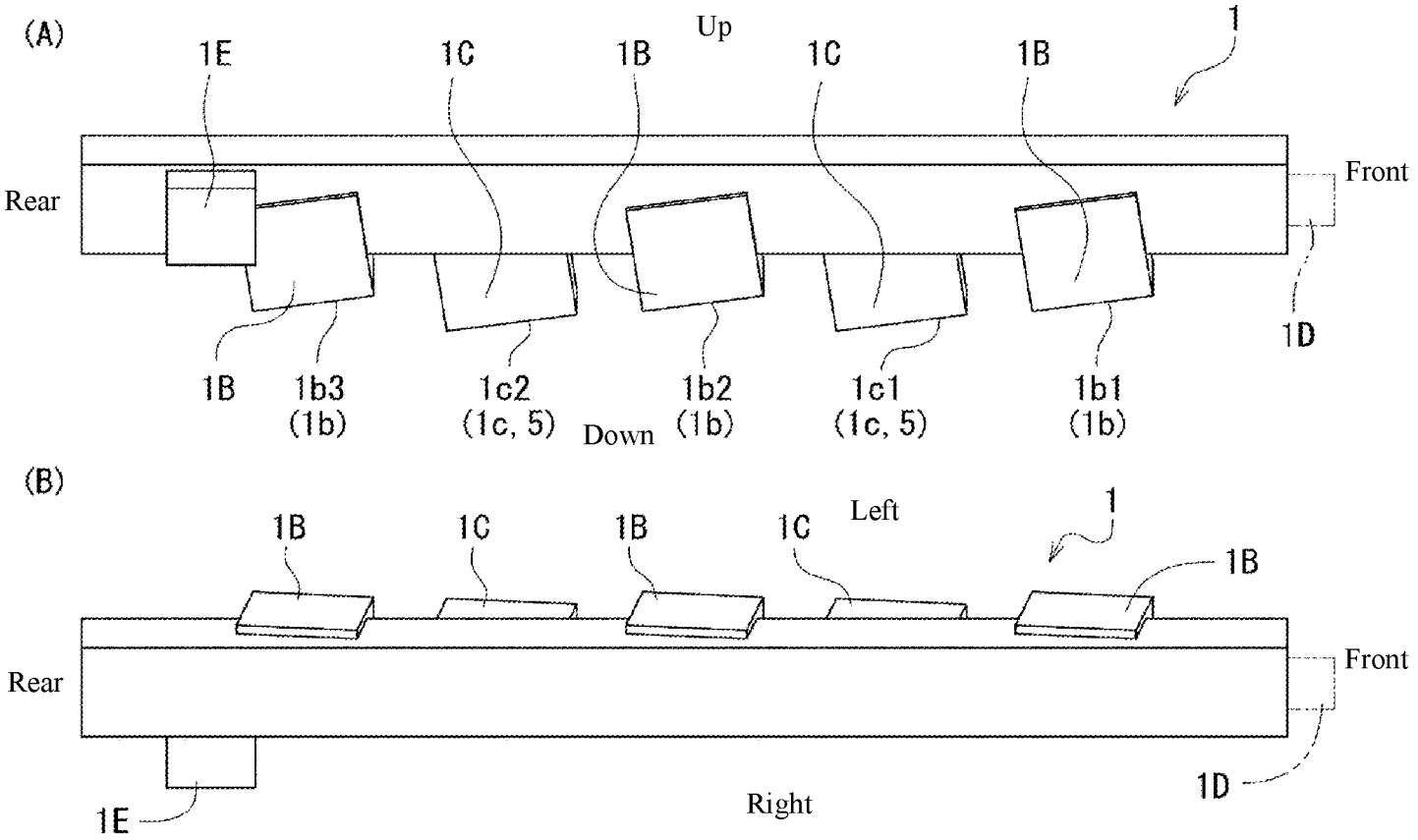

More specifically, as illustrated in FIG. 9 and FIG. 11, a first joining surface 1*b*1 that is the first surface from the front side and a first bottom surface 1*c*1 that is the first surface from the front side are disposed on the same plane S. On the other hand, a second joining surface 1*b*2 that is the second surface from the front side and a second bottom surface 1*c*2 that is the second surface from the front side are on the same plane T. There is no bottom surface 1*c* that is disposed on the same plane U as a third joining surface 1*b*3 that is the third (rearmost) one from the front side. Here, five surfaces consisting of these four surfaces, that is, the first joining surface 1*b*1, the first bottom surface 1*c*1, the second joining surface 1*b*2, the second bottom surface 1*c*2, and the third joining surface 1*b*3 that is the third (rearmost) surface from the front side are parallel to each other.

As illustrated in FIG. 5, FIG. 10, and FIG. 11, on the portion to be supported 1C, a nut portion 1*n* for fastening the support bolt 6, and an upward hole 1*f* into which the pin 28 is inserted are formed. Further, a mounting hole 1*g* into which an upper portion of the injector 2 is inserted is formed in the joining portion 1B.

That is, the mounting leg portion 3A is disposed on the rear side (an example of one end side) of the mounting portion 3C, and the aligning leg portion 3B is disposed on the front side (an example of the other end side) of the mounting portion 3C. The support bracket 3 is formed of a member having a downwardly-opened U-shape as viewed in a direction intersecting with a direction along which the cylinders are arranged in series (a direction from a right and slightly rear side to a left and slightly front side).

In an assembled state where the common rail 1 is mounted on the cylinder head 12 using the support brackets 3, 3, three injectors 2 that are inserted into and are mounted on the cylinder head 12 and the common rail 1 are directly joined (connected) to each other. Further, the removal of the injectors 2 in the upward direction is also prevented. In FIG. 1 to FIG. 3 and FIG. 5, numeral 31 indicates a blow-by returning pipe that connects a top portion of the head cover 13 and an intake manifold 23 to each other so as return a blow-by gas.

As illustrated in FIG. 8 to FIG. 11, an axis Y of the aligning leg portion 3B of the support bracket 3 (an axis of the knock hole 3*b*) is set to an angle θ parallel to an angle (an angle with respect to a direction perpendicular to the head upper surface 12A) of the injection axis P. That is, the knock hole 3*b* and the upward hole 1*f* have an axis Y orthogonal to the joining surface 1*b*. The axis of the joining portion 1B (the axis of the mounting hole 1*g*) is the same as the injection axis P. Both an axis Q of the nut portion 1*n* and the through hole 3*e* and the axis Y of the knock hole 3*b* and the upward hole 1*f* are set to be parallel to the injection axis P. The direction of the axis (not illustrated in the drawing) of the mounting leg portion 3A (the through hole 3*a*, the bolt 29) is the direction perpendicular to the head upper surface 12A.

The first joining surface 1*b*1 and the first bottom surface 1*c*1 can be formed by one machining action, the second joining surface 1*b*2 and the second bottom surface 1*c*2 can be formed by one machining action, and the third joining surface 1*b*3 can be formed by one machining action and hence, it is sufficient to perform three machining actions in total. Accordingly, the embodiment has an advantage that the engine head can be formed by performing the small number of machining actions compared to a case where two bottom surfaces 1*c* and three joining surfaces 1*b* are disposed on planes different from each other so that five machining actions are required in total. Further, the technical feature that two bottom surfaces 1*c* and three joining surfaces 1*b* are set at the same inclination angle is also preferable because the technical feature can contribute to the improvement of machining accuracy and the reduction of a machining cost. The configuration may be adopted where "two bottom surfaces 1*c* and three joining surfaces 1*b* are surfaces that are parallel to each other" in place of the configuration where "two bottom surfaces 1*c* and three joining surfaces 1*b* are on the same plane". With such a configuration, it is possible to obtain an advantageous effect that setting of an angle of a machining tool requires only one action compared to a case where two bottom surfaces 1*c* and three joining surfaces 1*b* are not parallel to each other.

Figure 4:
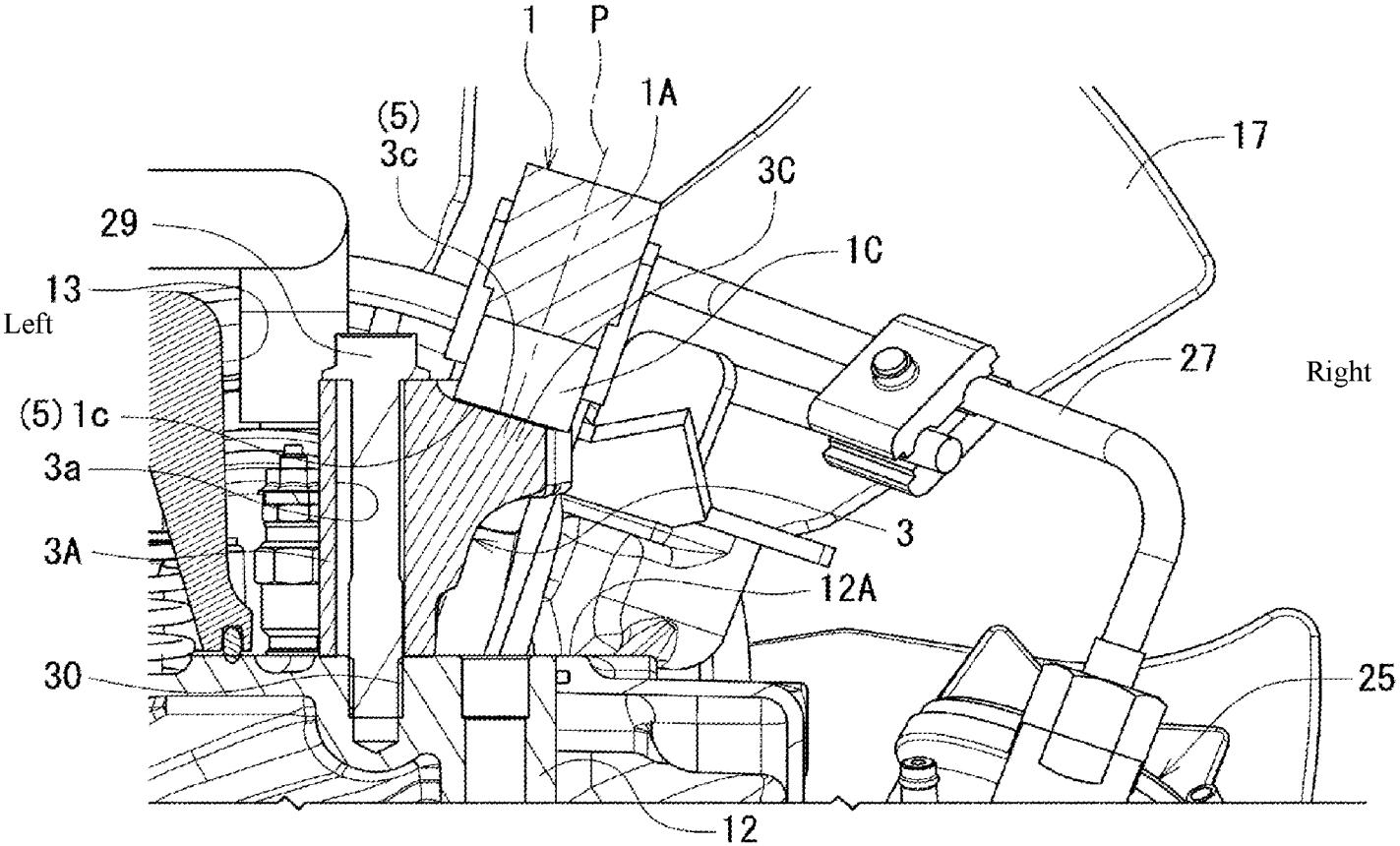
FIG. 4 is a back view with a part broken away of a main part illustrating a structure for supporting a common rail.
Figure 6:
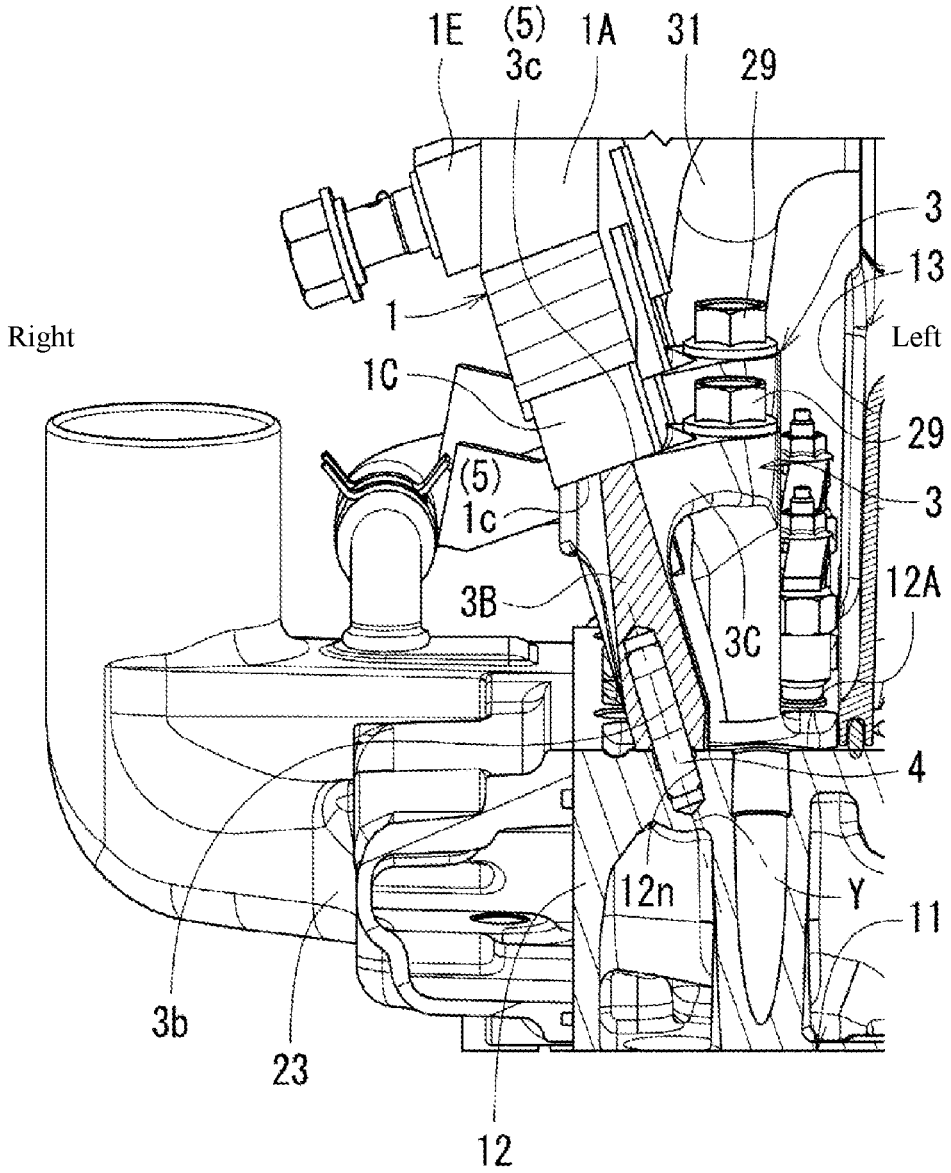
FIG. 6 is a front view with a part broken away illustrating the main part of the structure for supporting the common rail as viewed obliquely from an upper side.
Figure 7:
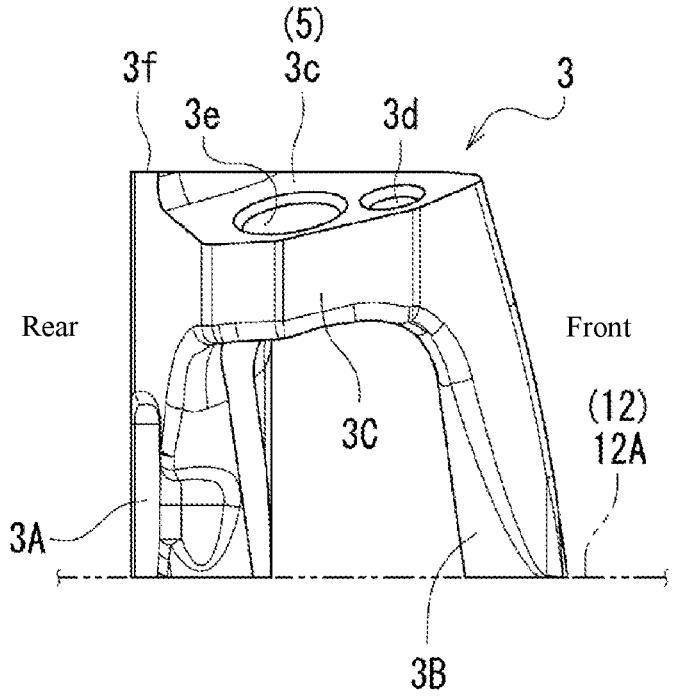
Figure 7:
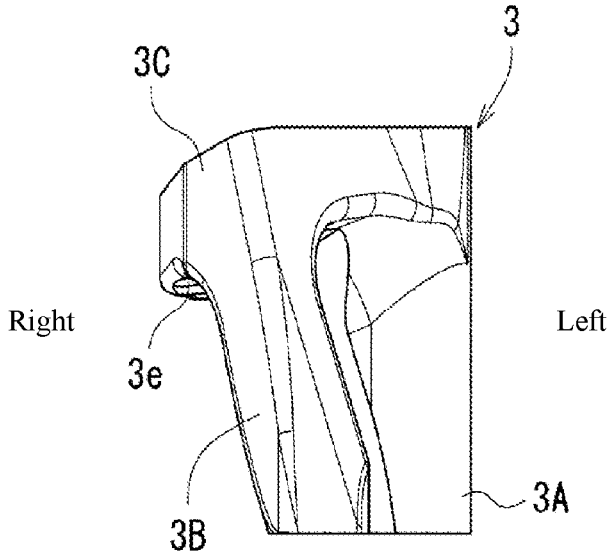
Figure 8:
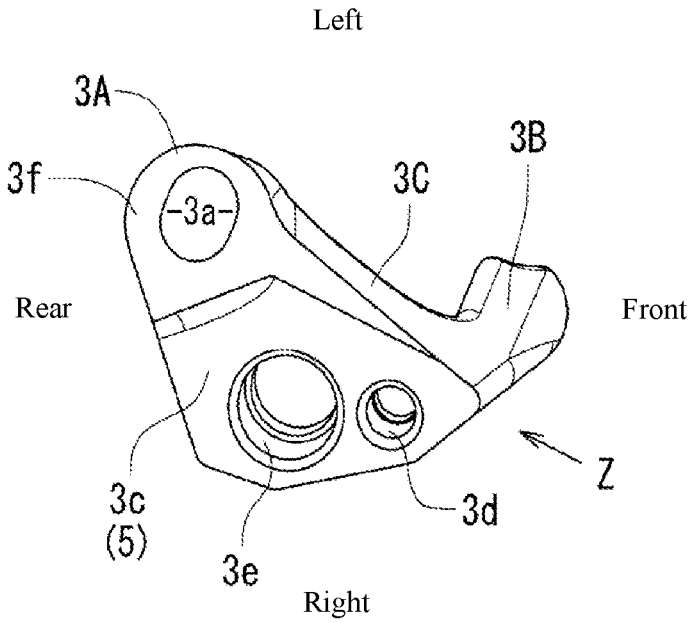
Figure 8:
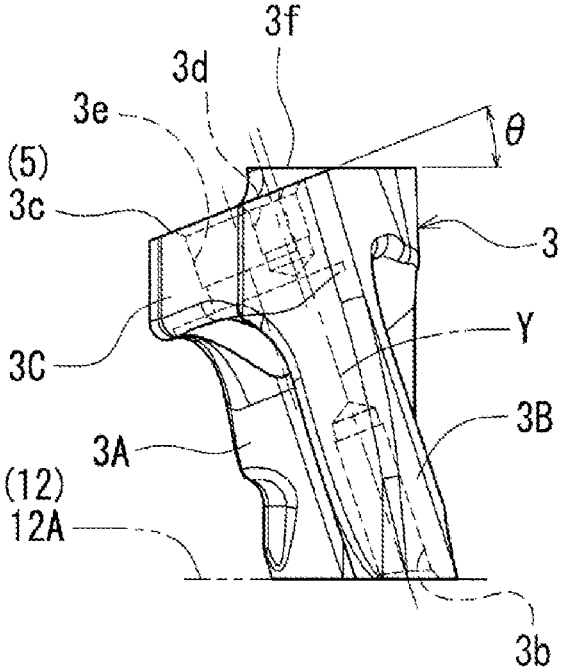

An operation of assembling the common rail 1 to the cylinder head 12 is performed as follows as illustrated in FIG. 4 to FIG. 6. First, the common rail 1 and two support brackets 3, 3 are assembled to each other using the support bolts 6 and the pins 28. Next, the common rail 1 to which two support brackets 3, 3 are assembled (assembled in advance) is assembled as follows. That is, the respective support brackets 3, 3 are fixed by fastening to the head upper surface 12A using two bolts 29, 29 in a state where the mounting holes 1*g* formed in the respective joining portions 1B and the corresponding injectors 2 are made to engage with each other by fitting, and the respective support brackets 3 and the cylinder head 12 are positioned by the knock pins 4.

In a state where the common rail 1 is assembled to the cylinder head 12, the configuration is provided where the common rail 1 and the respective injectors 2 are joined (connected) to each other, and a mounting state of the injectors 2 is maintained such that the removal of the injector 2 from the cylinder head 12 in the upward direction can be prevented. The common rail 1 and the respective support brackets 3 are positioned by the pins 28, and the respective support brackets 3 and the cylinder head 12 are positioned by the knock pins 4. By mounting the support brackets 3, 3 on the cylinder head 12 by the bolts 29, 29, it is possible to join (connect) three joining portions 1B and three injectors 2 to each other without difficulty.

It is also possible to adopt assembling operation steps in which two support brackets 3 and three injectors 2 are assembled to the common rail 1 in advance, and the common rail 1 to which two support brackets 3 and three injectors 2 are assembled is assembled to the cylinder head 12 by way of two support brackets 3.

According to the engine head structure according to the embodiment of the present invention, the following advantageous effects 1. to 8. can be obtained. 1. The common rail 1 and the injectors 2 are directly joined (connected) to each other. Accordingly, compared with a case where the common rail 1 and the injectors 2 are connected to each other by pipes, it is possible to reduce a pressure loss and to improve the fuel consumption due to such reduction of a pressure loss, and it is also possible to reduce a cost. Further, also from a point of view that brackets for the injectors 2 can be eliminated, it is possible to realize the reduction of a cost and the enhancement of reliability of components. 2. The common rail 1 is mounted on the cylinder head 12 by the support brackets 3. Accordingly, the vibration frequency of the common rail 1 and the vibration frequency of the brackets 3 can be made equal and hence, it is possible to acquire an advantageous effect that a cost can be reduced and durability and reliability are enhanced.

3. The overflow outlet portion 1E (having an overflow function) is formed in the common rail 1 itself. Accordingly, compared with a unit where an overflow pipe is provided to each injector, assembling and disassembling of the engine head structure can be simplified and, further, such a configuration can also contribute to the reduction of a cost. 4. The configuration is adopted where the bolts for fixing the common rail 1 and the support brackets 3 to each other are fastened from below the mounting portion 3C. Accordingly, there is no possibility that the support brackets 3 are located at the position higher than the common rail 1 and hence, the engine head structure can be manufactured in a compact shape in terms of height.

5. The support bracket 3 is formed in a downwardly-opened "U" shape where the mounting leg portion 3A and the aligning leg portion 3B extend downward from the respective ends of the mounting portion 3C. Accordingly, it is possible to avoid the interference between the support bolt 6 and the components disposed adjacently to the support bolt 6. As a result, it is possible to acquire an advantageous effect that the support bolt 6 can be mounted and removed even in a state where the support bracket 3 is assembled to the cylinder head 12 thus realizing excellent maintainability. The shape of the support bracket 3 may be shapes other than the "U" shape (for example, "a rectangular frame shape", "a laterally recessed" "U" shape or "a rectangular frame shape") provided that the support bolt 6 can be mounted, removed, and rotated. 6. The mounting surface 5 (the bottom surface 1*c*) of the common rail 1 with respect to the support bracket 3, and the joining surface 1*b* of the common rail 1 with respect to the injector 2 are disposed on the same plane S, T. Accordingly, it is possible to realize the reduction of a machining cost and the shortening of a machining time.

7. The knock pins 4 for positioning the support brackets 3 and the cylinder head 12 are disposed such that the common rail 1 and the injector 2 can be assembled (assembled in advance) to each other and, thereafter, the assembly can be assembled to the cylinder head 12. Accordingly, assembling can be performed easily, and a cost can be reduced. 8. The sleeve 7 that determines a mounting height of the injector 2 with respect to the cylinder head 12 is provided. Accordingly, the accuracy of the joining portion (the connecting portion) between the injector 2 and the common rail 1 is improved, and this accuracy of the joining portion can contribute to the enhancement of durability. Further, by press-fitting the sleeve 7 in the cylinder head 12, the rotation of the sleeve 7 can be prevented. Accordingly, such configuration is preferable.

Another Embodiment

For example, an in-line two-cylinder diesel engine may have a structure where a common rail is mounted in a state where a support bracket is disposed outside each injector. In this case, the configuration is adopted where "the support bracket 3 is disposed on a side of the fuel injection device 2".

DESCRIPTION OF REFERENCE SIGNS

1: Fuel accumulator (common rail)
1*b*: Joining surface
2: Fuel injection device (injector)
3: Support bracket
3A: Mounting leg portion
3B: Aligning leg portion
3C: Mounting portion
3*a*: Through hole
3*b*: Knock hole
3*e*: Through hole
4: Knock member
5: Mounting surface
12: Cylinder head
Y: Axis

The invention claimed is:

1. An engine head structure where a support bracket for mounting a fuel accumulator, that includes a joining portion with a fuel injection device on a cylinder head, is disposed on a side of the fuel injection device or between fuel injection devices disposed adjacently to each other, wherein the support bracket is formed of a member that includes:

a mounting portion on which the fuel accumulator is placed and mounted, a mounting leg portion that extends from the mounting portion and is mounted on the cylinder head, and an aligning leg portion that extends from the mounting portion for positioning the support bracket with respect to the cylinder head, the aligning leg having a knock hole and a knock member inserted in the knock hole, the knock member being for determining a relative position between the support bracket and the cylinder head; and the fuel accumulator includes:

a bottom surface that forms a mounting surface between the fuel accumulator and the mounting portion, and a joining surface formed of a lower surface of the joining portion, between the fuel accumulator and the fuel injection device and disposed adjacently to the support bracket having the mounting surface, the bottom surface and the joining surface both being on a same plane, wherein the knock hole has an axis orthogonal to the joining surface.

2. An engine head structure where a support bracket for mounting a fuel accumulator, that includes a joining portion with a fuel injection device on a cylinder head, is disposed on a side of the fuel injection device or between fuel injection devices disposed adjacently to each other, wherein the support bracket is formed of a member that includes:

a mounting portion on which the fuel accumulator is placed and mounted, a mounting leg portion that extends from the mounting portion and is mounted on the cylinder head, and an aligning leg portion that extends from the mounting portion for positioning the support bracket with respect to the cylinder head, wherein the mounting leg portion is disposed on one end side of the mounting portion, and the aligning leg portion is disposed on the other end side of the mounting portion, and the support bracket is set in a downwardly-opened U-shape.

3. The engine head structure according to claim 2, wherein the support bracket is set in a downwardly-opened U-shape as viewed in a direction intersecting with a direction that cylinders are arranged in series.

* * * * *